US009605394B1

(12) United States Patent
Lee

(10) Patent No.: US 9,605,394 B1
(45) Date of Patent: Mar. 28, 2017

(54) AUTOMATIC ROAD DIVIDING APPARATUS

(71) Applicant: LINENG-TECH CORPORATION, Hsinchu (TW)

(72) Inventor: Chih-Yu Lee, Hsinchu (TW)

(73) Assignee: LINENG-TECH CORPORATION, Hsinchu (TW)

( * ) Notice: Subject to any disclaimer, the term of this patent is extended or adjusted under 35 U.S.C. 154(b) by 0 days.

(21) Appl. No.: 14/993,019

(22) Filed: Jan. 11, 2016

(30) Foreign Application Priority Data

Sep. 7, 2015 (TW) ..... 104214446 U

(51) Int. Cl.
*E01F 15/00* (2006.01)
*E01F 13/04* (2006.01)

(52) U.S. Cl.
CPC ..... *E01F 13/046* (2013.01); *E01F 15/006* (2013.01)

(58) Field of Classification Search
CPC ..... E01F 13/046; E01F 13/123; E01F 13/026; E01F 13/00; E01F 15/006; E01F 15/00; E01F 15/003; F21S 8/083
See application file for complete search history.

(56) References Cited

U.S. PATENT DOCUMENTS 4,974,134 A * 11/1990 Bourne ..... F21S 8/028 362/286
5,068,773 A * 11/1991 Toth ..... F21S 8/028 362/153.1
5,142,463 A * 8/1992 Panagotacos ..... F21S 8/028 362/285
5,425,595 A * 6/1995 Roper ..... E01F 13/046 404/9
5,474,017 A * 12/1995 Mohebbi ..... E01F 13/046 116/209
5,476,338 A * 12/1995 Alberts ..... E01F 13/046 404/6
5,975,792 A * 11/1999 Goeken ..... E01F 13/046 404/6
2007/0068078 A1* 3/2007 Hosokawa ..... E01F 13/046 49/49
2007/0258762 A1* 11/2007 Stice ..... E01F 13/046 404/6
2008/0038057 A1* 2/2008 Stadler ..... E01F 13/046 404/6

(Continued)

*Primary Examiner* — Abigail A Risic
(74) *Attorney, Agent, or Firm* — Maschoff Brennan

(57) ABSTRACT

A road automatically dividing apparatus comprises a ground-embedded base, a telescopic tube set, an illuminating device, and a driving device. The ground-embedded base includes an accommodating space and an upper opening. The telescopic tube set, disposed in the accommodating space, includes a plurality of translucent column tubes which are connected telescopically and are relatively slidable in such a manner that each translucent column tube is converted between an expanding position and a collapsing position. The expanding position allows each translucent column tube expand from the neighboring one by sliding relatively to each other. The illuminating device is for emitting light penetrating the telescopic tube set. The driving device is configured to drive the telescopic tube set such that the telescopic tube set expands and collapses between the expanding position and the collapsing position.

5 Claims, 4 Drawing Sheets

(56) References Cited

U.S. PATENT DOCUMENTS

| | | | | |
|---|---|---|---|---|
| 2014/0147201 | A1* | 5/2014 | Ball | E01F 13/046 404/6 |
| 2015/0050084 | A1* | 2/2015 | Berto | E01F 13/046 404/6 |

* cited by examiner

AUTOMATIC ROAD DIVIDING APPARATUS

FIELD OF THE INVENTION

The present invention relates to a traffic cone, and more particularly to a road automatically dividing apparatus.

BACKGROUND OF THE INVENTION

A reversible lane is a lane where it allows traffic direction changed according to a predetermined configuration. Typically, a reversible lane is chosen as a lane between two lanes whose traffic directions reverse to each other for improving traffic flow during rush hours. For notifying drivers of the reversible lane, prior dividing columns are placed on one edge side of the reversible lane in a row for separating the reversible lane and its neighboring lane whose traffic directions are opposite. The prior dividing columns should be moved by manpower. For example, if the westward traffic flow is heavier than the eastward traffic flow, the dividing columns should be disposed between the reversible lane and the eastward lane by manpower for the purpose of notifying drivers of westward direction of the reversible lane. On the contrary, if the eastward traffic flow is heavier than the westward traffic flow, the dividing columns should be moved to positions between the reversible lane and the westward lane by manpower for the purpose of notifying drivers of the traffic eastward direction of the reversible lane. However, not only it is inconvenient for the movement of the dividing columns by manpower, but is dangerous for people who move the dividing columns across the lanes back and forth. Moreover, the dividing columns are easy to be toppled down and easy to be removed by the third party or any other unexpectedly force such as a wind force, by which it not only causes the dividing columns being ineffective for lane dividing, but also causes the dividing columns being lost and destroyed. It thus brings traffic hazard.

SUMMARY OF THE INVENTION

The present invention is for solving the disadvantages as described above.

Accordingly, the objective of the present invention is to provide a road automatically dividing apparatus which divides roads without manpower.

The road automatically dividing apparatus of the present invention comprises a ground-embedded base, a telescopic tube set, an illuminating device, and a driving device. The ground-embedded base, which is embedded under a ground, includes an accommodating space and an upper opening which links the accommodating space and the outer space. The telescopic tube set, disposed in the accommodating space, includes a plurality of translucent column tubes which are connected telescopically and are relatively slidable in such a manner that each translucent column tube is converted between an expanding position and a collapsing position. The expanding position allows each translucent column tube expand from the neighboring translucent column tube by sliding relatively to each other such that the telescopic tube set elongate upwards from the ground-embedded base to a road dividing height through the upper opening, and the collapsing position allows neighboring translucent column tubes slides and collapse to each other such that the telescopic tube set is collapsed to the interior of the accommodating space by enabling a height level of a top portion of the telescopic tube set which is lower than a height level of the upper opening. The illuminating device, disposed on the ground-embedded base or the telescopic tube set, is for emitting light penetrating the telescopic tube set. The driving device, connected to the telescopic tube set, is configured to drive the telescopic tube set such that the telescopic tube set expands and collapses between the expanding position and the collapsing position.

According to one embodiment of the present invention, the road automatically dividing apparatus further comprises a timing device electrically connected to the driving device, wherein the timing device sends a converting signal in a definite time to the driving device such that the driving device drives the telescopic tube set to convert between the expanding position and the collapsing position according to the converting signal.

According to one embodiment of the present invention, the road automatically dividing apparatus further comprises a remote-signal-receiving device electrically connected to the driving device, wherein the remote-signal-receiving device receives a converting signal from a remote end so that the driving device drives the telescopic tube set to convert between the expanding position and the collapsing position.

According to one embodiment of the present invention, the top portion of the telescopic tube set includes a translucent element through which the light emitted from the illuminating device penetrates upwards.

According to one embodiment of the present invention, he outer edge of the top portion of the telescopic tube set has a shape corresponding to the inner edge of the upper opening, and the top portion of the telescopic tube set seamlessly matches the upper opening when the telescopic tube set is at the collapsing position.

By means of the technology of the present invention, the road automatically dividing apparatus according to the present invention converts between the expanding position and the collapsing position. In the expanding position, the telescopic tube set acts as a barrier and the light emitted from the illuminating device penetrating the telescopic tube set can warn people. In the collapsing position, the telescopic tube set is collapsed to the interior of the ground-embedded base by being hided under the ground which has benefit to keep the ground flat. Besides, by the ground-embedded base, the road automatically dividing apparatus is concretely installed in the ground to overcome the disadvantages of being toppled down and being moved unexpectedly. As compared with the prior dividing columns, the road automatically dividing apparatus of the present invention is more convenient and efficient eliminating the risk for people who move dividing columns and ensuring the traffic safety.

BRIEF DESCRIPTION OF THE DRAWINGS

The structure and the technical means adopted by the present invention to achieve the above and other objects can be best understood by referring to the following detailed description of the preferred embodiments and the accompanying drawings.

DETAILED DESCRIPTION OF THE PREFERRED EMBODIMENTS

Figure 1:
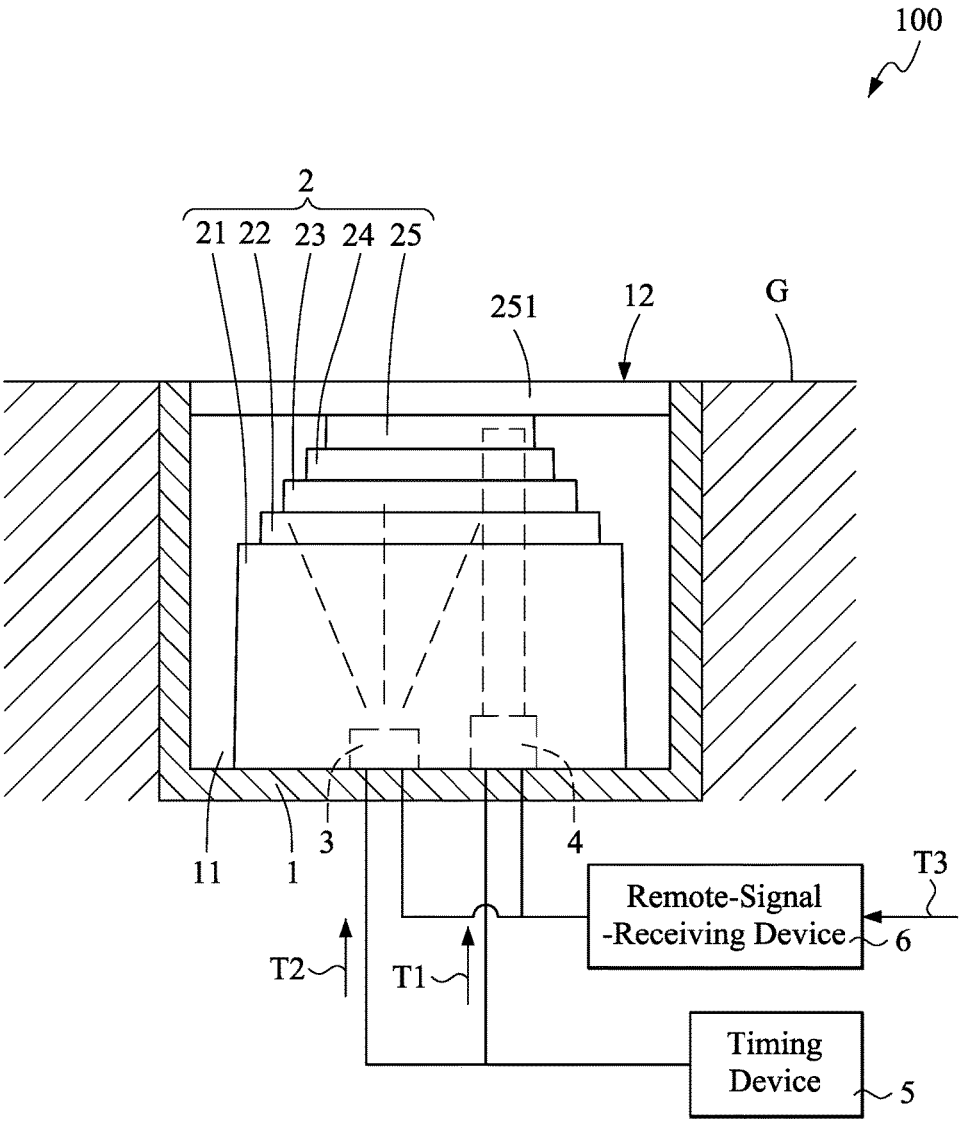
FIG. 1 is a perspective view illustrating the road automatically dividing apparatus according to one embodiment of the present invention, wherein the plurality of translucent column tubes are at the collapsing position.

The embodiments of the present invention are described below with reference to FIG. 1 to FIG. 4. The description is for describing the preferred embodiments of the present invention, and is not intended to limit the way of embodying the present invention.

Please refer to FIGS. 1 to 3B, a road automatically dividing apparatus 100 according to one embodiment of the present invention includes a ground-embedded base 1, a telescopic tube set 2, an illuminating device 3 and a driving device 4.

The ground-embedded base 1, which is for being embedded under a ground G, is provided with an accommodating space 11 and an upper opening 12 which communicates the accommodating space 11 and the outer space.

Figure 2:
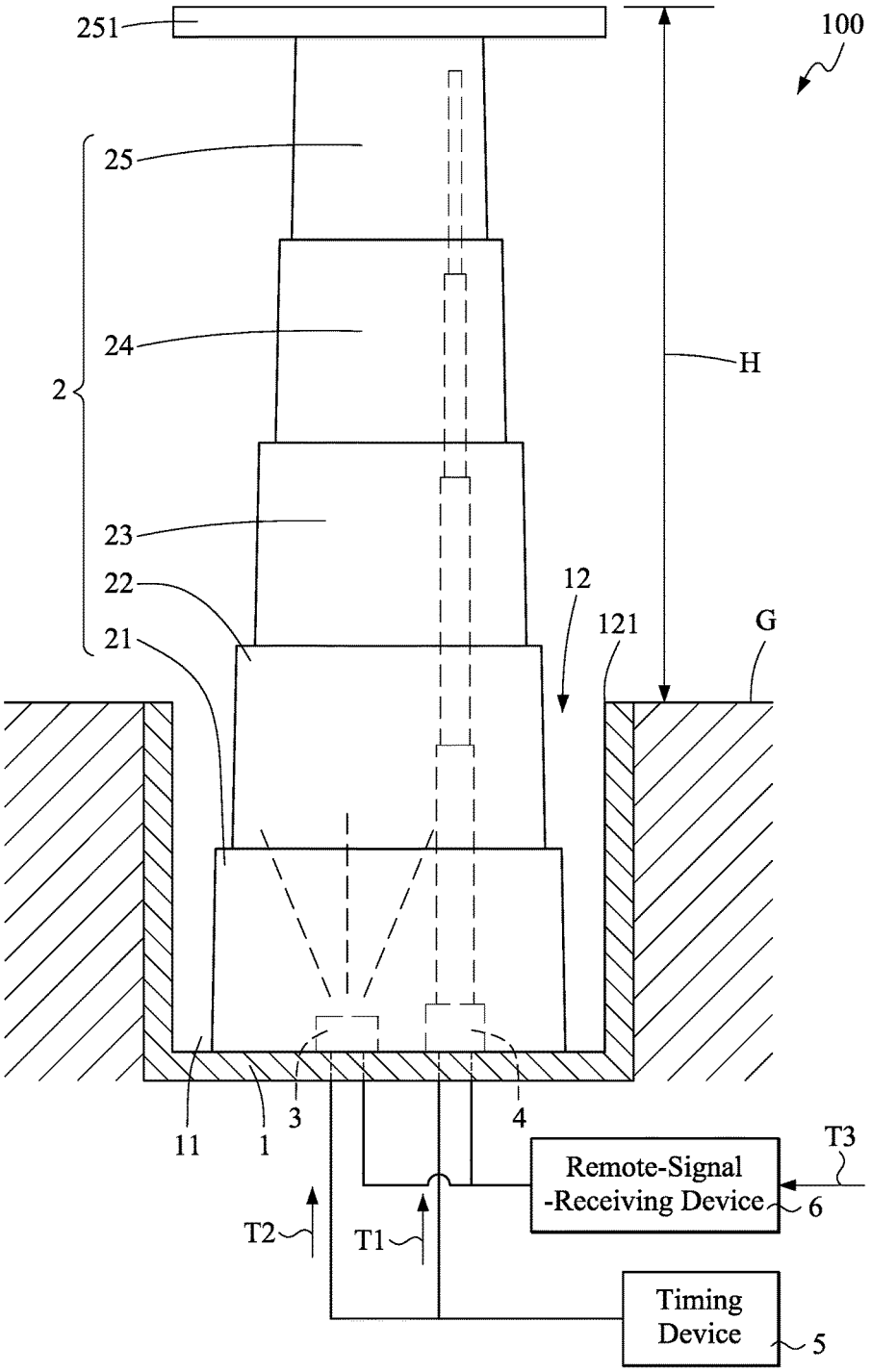
FIG. 2 is a schematic diagram illustrating the road automatically dividing apparatus according to the embodiment of the present invention, wherein the plurality of translucent column tubes are at the expanding position.

The telescopic tube set 2 is disposed in the accommodating space 11, and includes a plurality of translucent column tubes 21, 22, 23, 24 and 25 which are connected telescopically in a manner of being relatively slidable between an expanding position and a collapsing position. As shown in FIG. 1, in the collapsing position, the plurality of translucent column tubes 21, 22, 23, 24, and 25 are collapsed to the interior of the accommodating space 11 while a height level of a top portion 251 of the telescopic tube set 2 is lower than a height level of the upper opening 12 by sliding to each other. As shown in FIG. 2, in the expanding position, the plurality of translucent column tube 21, 22, 23, 24 and 25 are expanded to elongate upwards from the ground-embedded base to a road dividing height H through the upper opening 12 by sliding relatively to each other. It's worth noting that although five translucent column tubes have been shown, the present invention is not limited to this, and the telescopic tube set 2 may be composed of two translucent column tubes, three translucent column tubes, four translucent column tubes, or more than four translucent column tubes. In addition, the translucent column tubes may be made of transparent materialor translucent material.

In this embodiment, the outer edge of the top portion 251 of the telescopic tube set 2 has a shape corresponding to the inner edge 121 of the upper opening 12. In the collapsing position, the top portion 251 of the telescopic tube set 2 seamlessly matches the upper opening 12 with an equal altitude to the upper opening 12, as shown in FIG. 1). As a result, in the collapsing position, the top portion 251 of the telescopic tube set 2 is at an equal altitude to the ground G when the round-embedded base 1 is embedded under the ground G and the upper opening 12 is at an equal altitude to the ground G.

The illuminating device 3 is disposed at the ground-embedded base 1 for emitting light upwards. Since the translucent column tubes 21, 22, 23, 24 and 25 are transparent or translucent, the light emitted from the illuminating device 3 penetrates the telescopic tube set 2. In this embodiment, the top portion 251 of the telescopic tube set 2 is also a translucent element through which the light emitted from the illuminating device 3 penetrates upwards. As shown as dashed lines in FIG. 2, in the expanding position, the light penetrates the translucent column tubes 21, 22, 23, 24 and 25. The illuminating device 3 may be a light-emitting diode (LED) lamp, an incandescent light bulb, a fluorescent lamp, or a cold cathode fluorescent (CCFL) lamp, and the present invention is not limited to this.

The driving device 4, connected to the telescopic tube set 2, is configured to drive the telescopic tube set 2 such that the telescopic tube set 2 slide relative to each other between the expanding position and the collapsing position. The driving device 4 may be a device applying a telescopic rod and a motor to drive the telescopic tube set 2 to elongate or collapse by the motor rotating forward and reversely. The driving device 4 also may be a device applying a pulley assembly and a motor to drive the telescopic tube set 2. The motor provides power for the pulley assembly to drive the telescopic tube set 2. Alternatively, the driving device 4 can be a hydraulic device or a pneumatic device. It's worth noting that, in the embodiment, the driving device 4 is disposed in the interior of the telescopic tube set 2, but the present invention is not limited to this. The driving device 4 may be also disposed at other positions of the telescopic tube set 2.

The road automatically dividing apparatus 100 according to the embodiment further includes a timing device 5. The timing device 5 is electrically connected to the driving device 4 and the illuminating device 3. The timing device 5 is configured to send a converting signal T1 in a definite time to the driving device 4 such that the driving device 4 drives the telescopic tube set 2 to convert between the expanding position and the collapsing position according to the converting signal T1. The timing device 5 is also configured to send a converting signal T2 to turn on/off the illuminating device 3. For example, the timing device 5 may be configured to send the converting signal T2 to turn off the illuminating device 3 in the morning and turn on the illuminating device 3 in the evening.

The road automatically dividing apparatus 100 according to the embodiment further includes a remote-signal-receiving device 6. The remote-signal-receiving device 6 is signal-connected to the driving device 4 and the illuminating device 3, and is provided to receive a converting signal T3 from a controlling center 7 via a wired or wireless transmission. So that the driving device 4 drives the telescopic tube set 2 to convert between the expanding position and the collapsing position according to the converting signal T3, and the illuminating device 3 converts between turning on and turning off. The controlling center 7 is configured to provide an interface for users driving the telescopic tube set 2 to convert between the expanding position and the collapsing position.

Figure 3A:
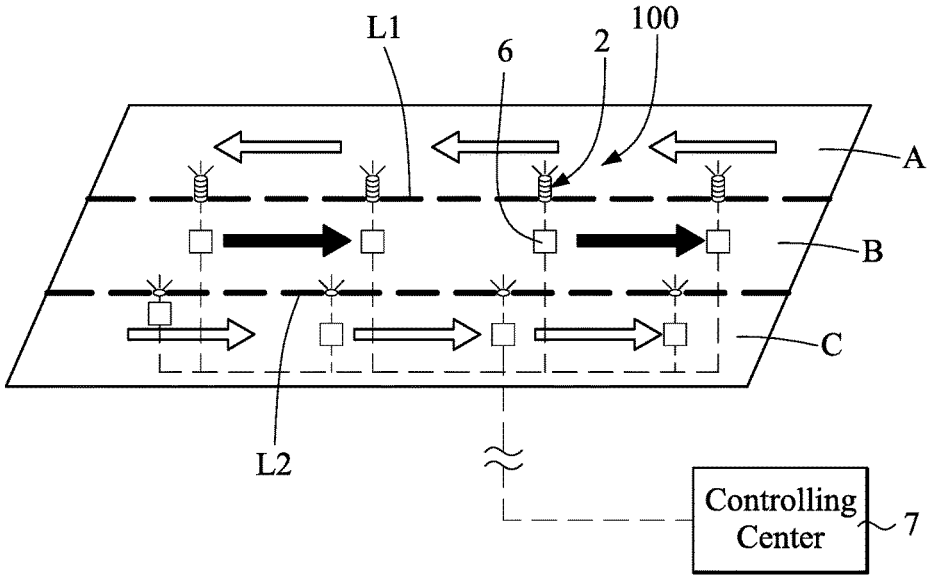
FIGS. 3A and 3B are schematic diagrams illustrating the road automatically dividing apparatus applied to a reversible lane according to the embodiment of the present invention.
Figure 3B:
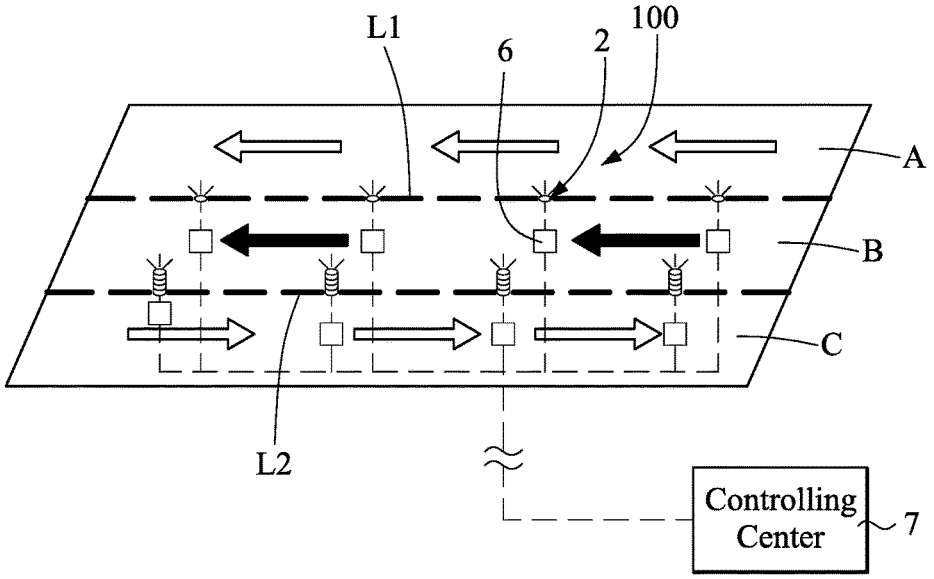

As shown in FIGS. 3A and 3B, the plurality of telescopic tube sets 2 and their corresponding ground-embedded bases 1 (not shown) are arranged in dividing lines L1 and L2, and the plurality of remote-signal-receiving devices 6 are connected to one controlling center 7. A westward lane A and an eastward lane C are provided with a reversible lane B therebetween, in which the dividing line L1 is used to separate the westward lane A and the reversible lane B, and the dividing line L2 is used to separate the eastward lane C and the reversible lane B. When the traffic flow in the eastward lane C is heavy, e.g., in the morning rush hour, the controlling center 7 sends a converting signal T3 to the remote-signal-receiving device 6 such that the telescopic tube sets 2 arranged in dividing line L1 convert to the expanding position and the telescopic tube sets 2 arranged in dividing line L2 convert to the collapsing position such that the reversible lane B can be served as an eastward lane for accommodating the heavy traffic flow in the eastward lane C. On the other hand, when the traffic flow in the westward lane A is heavy, e.g., in the evening rush hour, the controlling center 7 sends a converting signal T3 to the remote-signal-receiving device 6 such that the telescopic tube sets 2 arranged in dividing line L1 convert to the collapsing position and the telescopic tube sets 2 arranged in dividing line L2 convert to the expanding position so that the reversible lane B can be served as a westward lane for accommodating the heavy traffic flow in the westward lane A. Because the conversion of the telescopic tube sets 2 are controlled by the controlling center 7, the converting process of the telescopic tube sets 2 can be operated unmanned. As a result, the advantages of safety, convenience, and reducing labor costs are achieved by the unmanned converting process.

Figure 4:
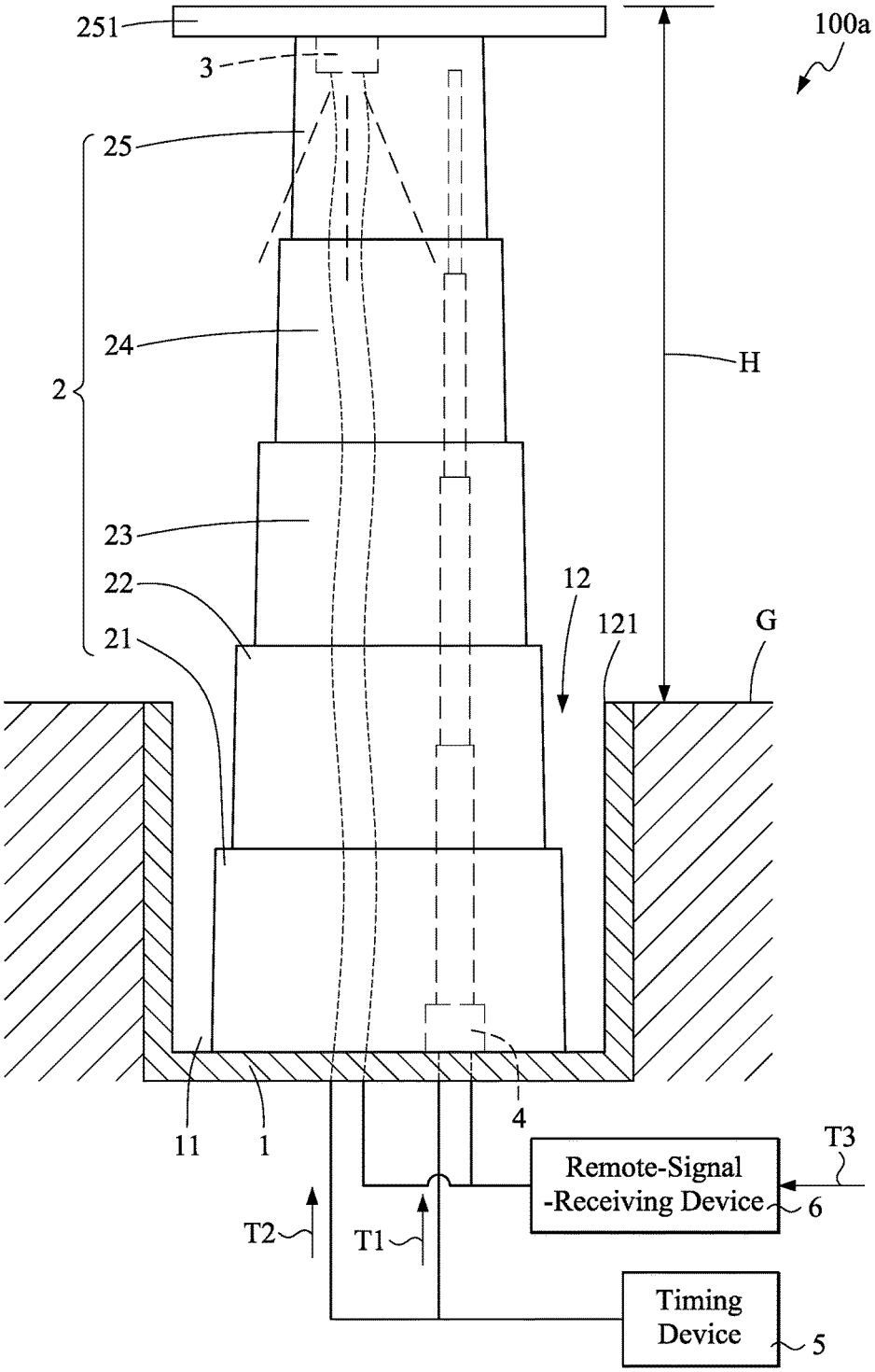
FIG. 4 is a schematic diagram illustrating the road automatically dividing apparatus according to another embodiment of the present invention.

As shown in FIG. 4, a road automatically dividing apparatus 100*a* according to another embodiment of the present invention is similar to the road automatically dividing apparatus 100 according to previous embodiment. The road automatically dividing apparatus 100*a* includes a ground-embedded base 1, a telescopic tube set 2, an illuminating device 3 and a driving device 4. The main difference of the two embodiments is that the illuminating device 3 in this embodiment is disposed at the top of the telescopic tube set 2 for emitting light downward.

According to the road automatically dividing apparatus provided by the present invention, the telescopic tube set 2 is converted between the expanding position and the collapsing position by driving device 4 driving the telescopic tube set 2, replacing the usage pattern of moving dividing columns by manpower in the prior art. Moreover, the road automatically dividing apparatus in the present invention is not limit to be applied to reversible lanes, it is also able to be applied to parking, fields of gathering, ticket windows, and so on. As a result, the road automatically dividing apparatus has the advantages of great versatility, fast to convert, convenience, and safety.

The above description should be considered as only the discussion of the preferred embodiments of the present invention. However, a person skilled in the art may make various modifications without deviating from the present invention. Those modifications still fall within the spirit and scope defined by the appended claims.

What is claimed is:

1. An automatic road dividing apparatus, comprising:

a ground-embedded base, which is embedded under a ground, including an accommodating space and an upper opening which links the accommodating space and the outer space;

a telescopic tube set, disposed in the accommodating space, consisting of a plurality of translucent column tube which include an outer translucent column tube and at least one inner translucent column tube collapsed within the outer translucent column tube thereby enabling the translucent column tubes to be telescopically and relatively slidable connected in such a manner that each inner translucent column tube is converted between an expanding position and a collapsing position, wherein the expanding position allows each inner translucent column tube to expand from the neighboring translucent column tube by sliding relatively to each other such that the inner translucent column tube is expanded upwards from the ground-embedded base to a road dividing height through the upper opening, and the collapsing position allows all neighboring inner translucent column tube to slide and collapse to each other such that each inner translucent column tube is collapsed to the interior of the accommodating space of the ground-embedded base thereby enabling a height level of a top portion of the telescopic tube set to be lower than a height level of the upper opening;

an illuminating device, disposed within the ground-embedded base or within the telescopic tube set, that emits light to penetrate through all translucent column tubes to outside of all translucent column tubes thereby illuminating light from the telescopic tube set; and a driving device, connected to the telescopic tube set, configured to drive the telescopic tube set such that the telescopic tube set expands and collapses between the expanding position and the collapsing position.

2. The automatic road dividing apparatus of claim 1, further comprising a timing device electrically connected to the driving device, wherein the timing device sends a converting signal in a definite time to the driving device such that the driving device drives the telescopic tube set to convert between the expanding position and the collapsing position according to the converting signal.

3. The automatic road dividing apparatus of claim 1, further comprising a remote-signal-receiving device electrically connected to the driving device, wherein the remote-signal-receiving device receives a converting signal from a remote end so that the driving device drives the telescopic tube set to convert between the expanding position and the collapsing position.

4. The automatic road dividing apparatus of claim 1, wherein the top portion of the telescopic tube set includes a translucent element through which the light emitted from the illuminating device penetrates upwards.

5. The automatic road dividing apparatus of claim 1, wherein the outer edge of the top portion of the telescopic tube set has a shape corresponding to the inner edge of the upper opening, and the top portion of the telescopic tube set seamlessly matches the upper opening when the telescopic tube set is at the collapsing position.

* * * * *